US008083935B2

(12) United States Patent
Eia

(10) Patent No.: US 8,083,935 B2
(45) Date of Patent: Dec. 27, 2011

(54) CUTTINGS VESSELS FOR RECYCLING OIL BASED MUD AND WATER

(75) Inventor: Jan Thore Eia, Kvernaland (NO)

(73) Assignee: M-I LLC, Houston, TX (US)

( * ) Notice: Subject to any disclaimer, the term of this patent is extended or adjusted under 35 U.S.C. 154(b) by 468 days.

(21) Appl. No.: 12/020,067

(22) Filed: Jan. 25, 2008

(65) Prior Publication Data

US 2008/0210467 A1 Sep. 4, 2008

Related U.S. Application Data

(60) Provisional application No. 60/887,444, filed on Jan. 31, 2007.

(51) Int. Cl.
*B01D 21/01* (2006.01)
*B01D 17/05* (2006.01)
*C21B 43/40* (2006.01)

(52) U.S. Cl. ..... 210/96.1; 175/206; 210/143; 210/199; 210/202; 210/203; 210/257.1

(58) Field of Classification Search ..... 210/96.1
See application file for complete search history.

(56) References Cited

U.S. PATENT DOCUMENTS 4,160,734 A * 7/1979 Taylor et al. ..... 210/96.1
4,507,208 A * 3/1985 Simon et al. ..... 210/721
6,315,894 B1 * 11/2001 Wiemers et al. ..... 210/96.1
6,698,989 B2 3/2004 Snowdon et al.
6,702,539 B2 3/2004 Snowdon et al.
6,709,216 B2 3/2004 Snowdon et al.
6,709,217 B1 * 3/2004 Snowdon ..... 414/137.1
6,881,349 B2 * 4/2005 Mueller ..... 210/708
6,932,169 B2 8/2005 Wylie et al.
(Continued)

FOREIGN PATENT DOCUMENTS

EP 1054135 11/2000

OTHER PUBLICATIONS

PCT International Search Report issued in PCT Application No. PCT/US2008/052577 dated Jul. 23, 2008 (3 pages).
PCT Written Opinion issued in PCT Application No. PCT/US2008/052577 dated Jul. 23, 2008 (3 pages).

*Primary Examiner* — Peter A Hruskoci
(74) *Attorney, Agent, or Firm* — Osha Liang LLP

(57) ABSTRACT

A system for recycling a drilling fluid that includes a first cuttings storage vessel, a second cuttings storage vessel, and a module fluidly connected to the first and second cuttings storage vessels, the module having a valve configured to fluidly connect the first and second cuttings storage vessels. The module further includes a filter system configured to fluidly connect to at least the second cuttings storage vessel, and at least one pump to facilitate the flow of a fluid between the first and second cuttings storage vessels. Also, a module for use at a drilling location that includes a valve for directing drilling fluid between at least a first cuttings storage vessel disposed outside the module and a second cuttings storage vessel disposed outside the module. The module further includes a filter system for filtering the drilling fluid and at least one pump for facilitating the flow of the fluid between at least the first and second cuttings storage vessels.

16 Claims, 4 Drawing Sheets

U.S. PATENT DOCUMENTS 6,977,048 B2 12/2005 Mueller et al.
6,988,567 B2 * 1/2006 Burnett et al. ..... 175/66
7,135,107 B2 * 11/2006 Palmer ..... 210/104
7,514,005 B2 * 4/2009 Browne et al. ..... 210/708
7,520,342 B2 * 4/2009 Butler et al. ..... 175/66
7,527,726 B2 * 5/2009 Slough et al. ..... 210/96.1
7,730,966 B2 * 6/2010 Fragachan ..... 175/24
7,823,607 B2 * 11/2010 Eide ..... 137/899.2
7,828,084 B2 * 11/2010 Eia et al. ..... 175/66
7,971,657 B2 * 7/2011 Hollier et al. ..... 175/66

* cited by examiner

CUTTINGS VESSELS FOR RECYCLING OIL BASED MUD AND WATER

CROSS-REFERENCE TO RELATED APPLICATION

This application, pursuant to 35 U.S.C. §119(e), claims priority to U.S. Provisional Application Ser. No. 60/887,444, filed Jan. 31, 2007. That application is incorporated by reference in its entirety.

BACKGROUND

1. Field of the Disclosure

Embodiments disclosed herein relate generally to systems and methods for recycling drilling fluids at a drilling location. More specifically, embodiments disclosed herein relate to systems and methods for recycling drilling fluids at a drilling location using a module-based drilling fluid recovery system. More specifically still, embodiments disclosed herein relate to systems and methods for recycling drilling fluids at a drilling location using a module to convert cutting storage and transfer vessels into a drilling fluid recovery system.

2. Background

In the drilling of wells, a drill bit is used to dig many thousands of feet into the earth's crust. Oil rigs typically employ a derrick that extends above the well drilling platform. The derrick supports joint after joint of drill pipe connected end to end during the drilling operation. As the drill bit is pushed further into the earth, additional pipe joints are added to the ever lengthening "string" or "drill string". Therefore, the drill string includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In the Gulf of Mexico, for example, there are hundreds of drilling platforms that drill for oil and gas by drilling into the subsea floor. These drilling platforms may be used in places where the depth of the water is many hundreds of feet. In such a marine environment, the water is typically filled with marine life that cannot tolerate the disposal of drill cuttings waste. Therefore, there is a need for a simple, yet workable solution to the problem of disposing of well cuttings, drilling mud, and/or other waste in marine and other fragile environments.

Traditional methods of disposal include dumping, bucket transport, cumbersome conveyor belts, screw conveyors, and washing techniques that require large amounts of water. Adding water creates additional problems of added volume and bulk, pollution, and transport problems. Installing conveyors requires major modification to the rig area and involves extensive installation hours and very high cost.

Another method of disposal includes returning the drill cuttings, drilling mud, and/or other waste via injection under high pressure into an earth formation. Generally, the injection process involves the preparation of a slurry within surface-based equipment and pumping the slurry into a well that extends relatively deep underground into a receiving stratum or adequate formation. The basic steps in the process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

In some instances, the cuttings, which are still contaminated with some oil, are transported from a drilling rig to an offshore rig or ashore in the form of a thick heavy paste or slurry for injection into an earth formation. Typically the material is put into special skips of about 10 ton capacity that are loaded by crane from the rig onto supply boats. This is a difficult and dangerous operation that may be laborious and expensive.

U.S. Pat. No. 6,709,216 and related patent family members disclose that cuttings may also be conveyed to and stored in an enclosed, transportable vessel, where the vessel may then be transported to a destination, and the drill cuttings may be withdrawn. The transportable storage vessel has a lower conical section structured to achieve mass flow of the mixture in the vessel, and withdrawal of the cuttings includes applying a compressed gas to the cuttings in the vessel. The transportable vessels are designed to fit within a 20 foot ISO container frame. These conical vessels will be referred to herein as ISO vessels.

As described in U.S. Pat. No. 6,709,216 and family, the ISO vessels may be lifted onto a drilling rig by a rig crane and used to store cuttings. The vessels may then be used to transfer the cuttings onto a supply boat, and may also serve as buffer storage while a supply boat is not present. Alternatively, the storage vessels may be lifted off the rig by cranes and transported by a supply boat.

Space on offshore platforms is limited. In addition to the storage and transfer of cuttings, many additional operations take place on a drilling rig, including tank cleaning, slurrification operations, drilling, chemical treatment operations, raw material storage, mud preparation, mud recycle, mud separations, and others.

Due to the limited space, it is common to modularize these operations and to swap out modules when not needed or when space is needed for the equipment. For example, cuttings containers may be offloaded from the rig to make room for modularized equipment used for slurrification. These lifting operations, as mentioned above, are difficult, dangerous, and expensive. Additionally, many of these modularized operations include redundant equipment, such as pumps, valves, and tanks or storage vessels.

In other drilling operations, cuttings containers may be offloaded from the rig to make room for environmental and/or drilling fluid recycling systems. Such systems may include a number of mixing, flocculating, and storage tanks to clean industrial wastewater produced during drilling or shipping operations. Examples of such environmental and drilling fluid recycling methods and systems are disclosed in U.S. Pat. Nos. 6,881,349 and 6,977,048, assigned to the assignee of the present application, and hereby incorporated in their entirety. While theses systems and methods provide improved processes in recycling drilling fluid, they require the difficult, dangerous, and expensive lifting and installation operations, as described above.

Accordingly, there exists a continuing need for systems and methods for efficiently recycling drilling fluids at a drilling location.

SUMMARY OF THE DISCLOSURE

In one aspect, embodiments disclosed herein relate to a system for recycling a drilling fluid that includes a first cuttings storage vessel and a second cuttings storage vessel. The system further includes a module fluidly connected to the first and second cuttings storage vessels, the module having a valve configured to fluidly connect the first and second cuttings storage vessels. The module further includes a filter system configured to fluidly connect to at least the second cuttings storage vessel, and at least one pump to facilitate the flow of a fluid between the first and second cuttings storage vessels.

In another aspect, embodiments disclosed herein relate to a module for use at a drilling location that includes a valve for directing drilling fluid between at least a first cuttings storage vessel disposed outside the module and a second cuttings storage vessel disposed outside the module. The module further includes a filter system for filtering the drilling fluid and at least one pump for facilitating the flow of the fluid between at least the first and second cuttings storage vessels.

In another aspect, embodiments disclosed herein relate to a method of operating a drilling fluid recycling system including using a vessel for cuttings storage, and operating the vessel in a drill fluid recycling system.

Other aspects and advantages of the disclosure will be apparent from the following description and the appended claims.

DETAILED DESCRIPTION

In one aspect, embodiments disclosed herein relate to systems and methods for recycling drilling fluids at a drilling location. The drilling location may include both onshore and offshore drill sites. Additionally, embodiments disclosed herein relate to systems and methods for recycling drilling fluids using a module-based drilling fluid recovery system. More specifically, such embodiments relate to methods of using a module-based drilling fluid recovery system to convert cuttings storage and transfer vessels into components of the drilling fluid recovery system.

Figure 1:
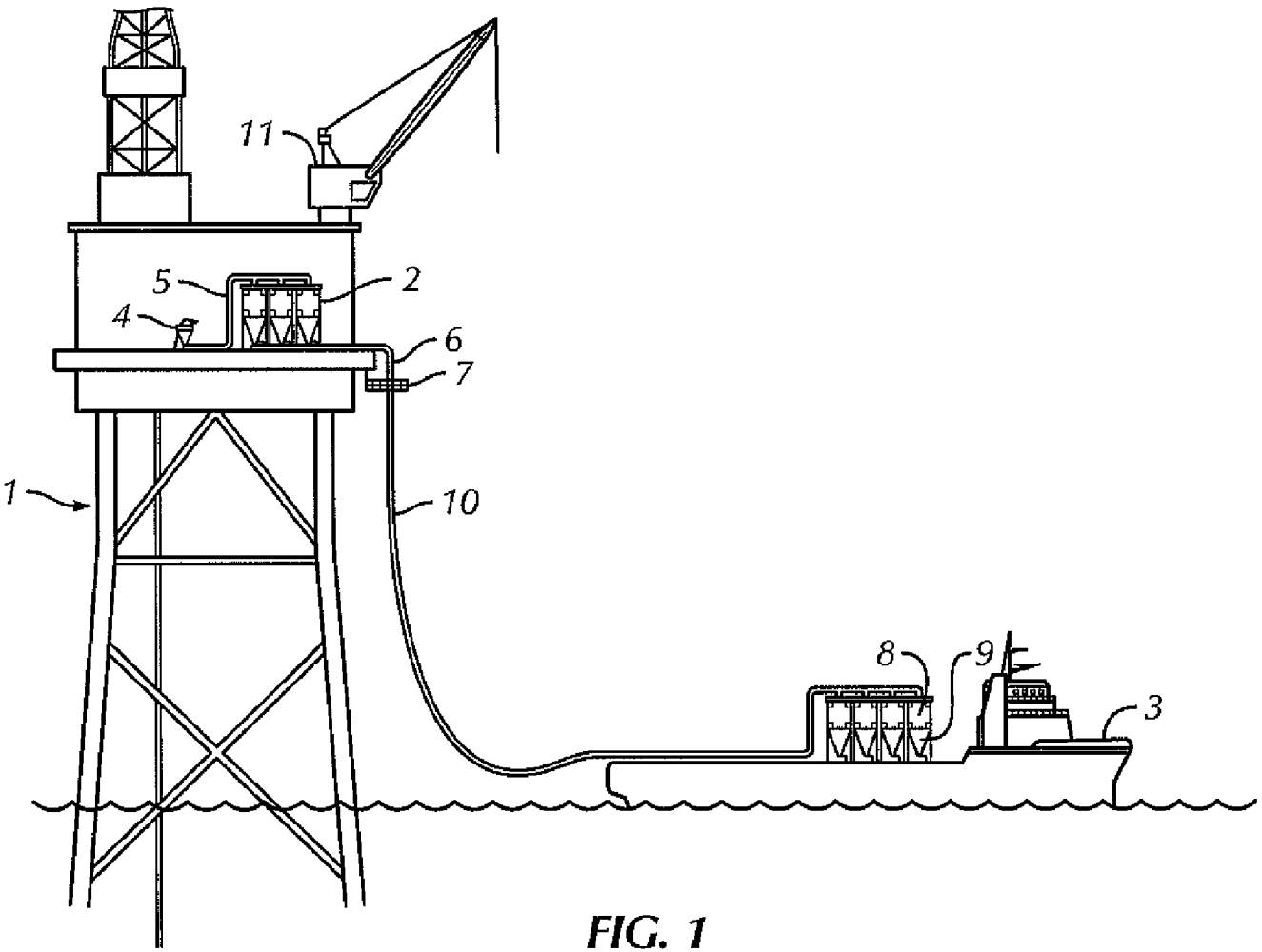
FIG. 1 shows a method of offloading drill cuttings from an off-shore rig according to one embodiment of the present disclosure.

Referring initially to FIG. 1, a method of offloading drill cuttings from an offshore drilling rig according to one embodiment of the present disclosure is shown. In this embodiment, an offshore rig 1 may have one or more cuttings storage vessels 2 located on its platform. Cuttings storage vessels 2 may include raw material storage tanks, waste storage tanks, or any other vessels commonly used in association with drilling processes. Specifically, cuttings storage vessels 2 may include, for example, cuttings boxes and/or ISO-tanks (i.e., International Organization for Standardization tanks). In some embodiments, cuttings storage vessels 2 may include several individual vessels fluidly connected to allow the transference of cuttings therebetween. Such cuttings storage vessels 2 may be located within a support framework (not shown), such as an ISO container frame. As such, those of ordinary skill in the art will appreciate that cuttings storage vessels 2 may be used for both drill cuttings storage and transport.

As described above with respect to prior art methods, when cuttings storage vessels 2 are no longer needed during a drilling operation, or are temporarily not required for operations taking place at the drilling location, cuttings storage vessels 2 may be offloaded to a supply boat 3. Other systems and vessels for performing different operations may then be lifted onto the rig via crane 11, and placed where cuttings storage vessels 2 were previously located. In this manner, valuable rig space may be saved; however, conserving space in this manner may require multiple dangerous and costly crane lifts.

In contrast to the prior art methods described above, embodiments disclosed herein integrate cuttings storage vessels 2 into two or more operations that are performed on drilling rig 1. In one aspect, embodiments disclosed herein relate to integrating cuttings storage vessel 2 to operate in at least two operations on rig 1. In some aspects, embodiments disclosed herein relate to integrating cuttings storage vessel 2 to be used for both cuttings storage/transfer, as well as a second operation. More specifically, embodiments disclosed herein relate to using cuttings storage vessel 2 as both a storage/transfer vessel, as well as a component in a drilling fluid recovery system. Although described with respect to integrating cuttings storage vessel 2 into a drilling fluid recovery system, those skilled in the art will appreciate that any vessel located at a drill site for performing a specified drilling operation may be integrated into the systems and methods for recycling drilling fluid disclosed herein. Furthermore, those of ordinary skill in the art will appreciate that the system for recycling drilling fluid may include a number of environmental methods for treating and/or cleaning drilling fluid and drilling waste products, as are described below.

Still referring to FIG. 1, offshore rig 1 may include one or more cuttings storage vessels 2 located on its platform. Drill cuttings generated during the drilling process may be transferred to cutting storage vessels 2 for storage and/or subsequent transfer in a number of different ways. One such method of transferring drill cuttings is via a pneumatic transfer system including a cuttings blower 4 and pneumatic transfer lines 5. Examples of systems using forced flow pneumatic transfer are disclosed in U.S. Pat. Nos. 6,698,989, 6,702,539, and 6,709,216, hereby incorporated by reference herein. However, those of ordinary skill in the art will appreciate that other methods for transferring cuttings from a cleaning operation (e.g., using vibratory separators) to cuttings storage vessels 2 may include augers, conveyors, and pneumatic suction systems.

In a system using pneumatic cuttings transfer, when cuttings need to be offloaded from a rig 1 to supply boat 3, cuttings may be discharged through pipe 6 to a hose connection pipe 7. Supply boat 3 is fitted with a supply assembly 8, wherein supply assembly 8 may include a number of additional cuttings storage vessels 9, including, for example, ISO-tanks. Supply boat 3 may be brought proximate to rig 1, and a flexible hose 10 extended therebetween. In this embodiment, flexible hose 10 fluidly connects storage assembly 8 to cuttings storage vessels 2 via connection pipe 7.

Figure 2:
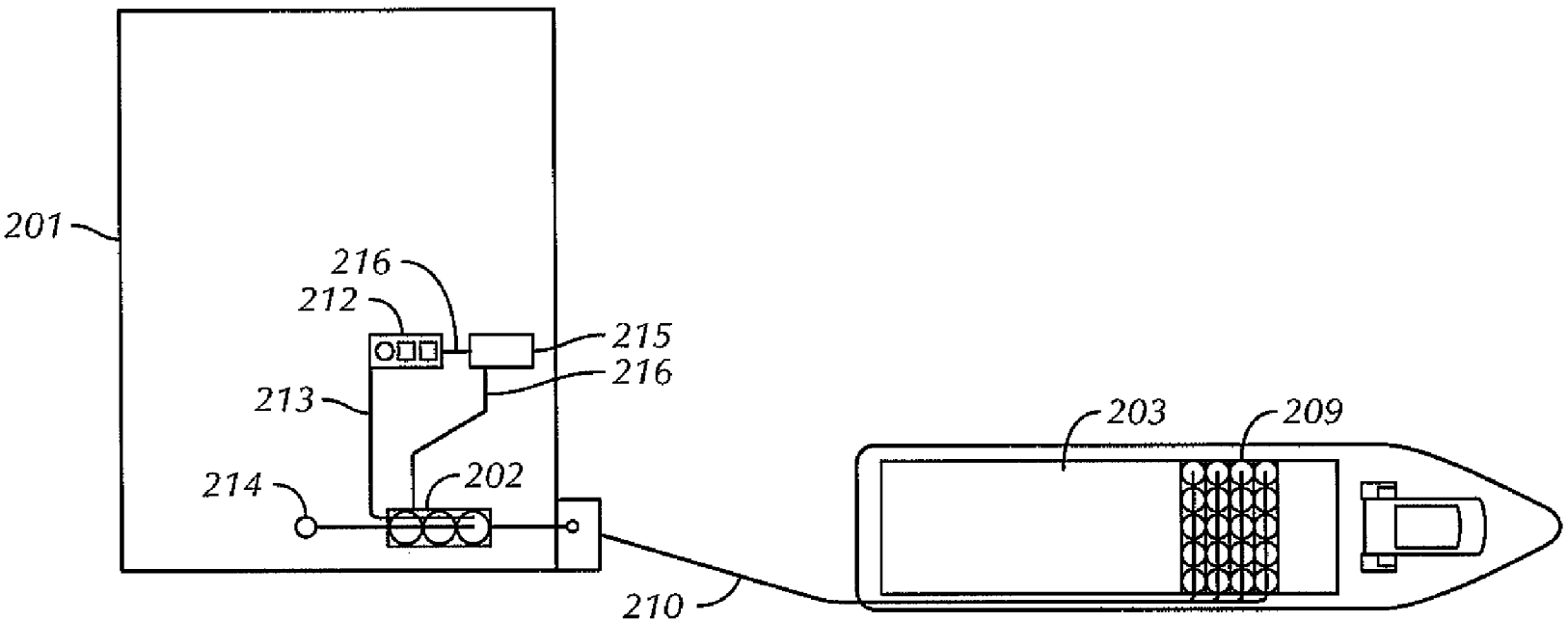
FIG. 2 shows a top view of a system for recycling drilling fluid according to one embodiment of the present disclosure.

Referring to FIG. 2, a rig 201 including a drilling fluid recycling module 212 in accordance with one embodiment of the present disclosure is shown. In this embodiment, rig 201 includes a set of cuttings storage vessels 202 fluidly connected to recycling module 212 via a connection line 213. Cutting storage vessels 202 are detachably connected to a second set of storage vessels 209 located on a supply boat 203 by a flexible hose 210.

In operation, dry cuttings may be transferred to cuttings storage vessels 202 from a pneumatic transfer device 214 located on rig 201. Pneumatic transfer device 214 may include, for example, a mass flow pneumatic transfer system, a vacuum assist transfer system, a cuttings blower, or an ISO-Pump™, as described above. The dry cuttings may be stored in cuttings storage vessels 202 until they are transferred to supply boat 203 for transport or disposal thereafter. Typically, during cleaning of the drill cuttings, upstream cleaning devices (e.g., vibratory shakers) generate both dry cuttings and fluids. While the cuttings may be transferred to cuttings storage vessels 202, the fluids are collected in a drilling fluid reservoir 215. Examples of reservoirs may include storage tanks, pits, and collection vats, and those of ordinary skill in the art will appreciate that such reservoirs already exist as part of the rig 201 infrastructure.

In one embodiment, fluid reservoir 215 is fluidly connected to fluid recycling module 212 and/or cuttings storage vessels 202 via transfer lines 216. Transfer lines 216 may include flexible hosing and/or preexisting fluid communication lines used to transfer drilling fluid between operations on rig 201. As described above, drilling fluids are typically cleaned and recycled in independent systems located on rig 201 either permanently, or transferred to rig 201 from supply boat 203, when such operations are required. However, in this embodiment, fluid recycling module 212 is located on rig 201 proximate cuttings storage vessels 202, and transfer lines 213 and 216 are connected therebetween to integrate the cuttings storage vessels 202 and module 212 with preexisting fluid reservoirs 215. Such an integrated system allows for existing single-use structures (e.g., cuttings storage vessels 202) to be used in multiple operations (e.g., fluid recycling systems). Thus, in this embodiment, used drilling fluid collected either from the wellbore or from upstream cleaning operations may be pumped from drilling reservoir 215 to cuttings storage vessels 202 for cleaning and/or recycling.

As described above, previous fluid cleaning and recycling methods required the conversion of valuable drilling rig space for storing independent fluid recovery vessels and processing equipment. However, embodiments disclosed herein allow existing structural elements (i.e., cuttings storage vessels 202 and fluid reservoirs 215) to be used in multiple operations. Fluid recycling module 212 is relatively small compared to previous systems, thereby preserving valuable drill space, and preventing the need for costly and dangerous lifting operations. Those of ordinary skill in the art will appreciate that the system, as illustrated in FIGS. 1 and 2, is only exemplary, and alternate systems incorporating additional fluid cleaning components may also be use in drilling fluid recycling systems disclosed herein. Illustrative examples of such systems are described in greater detail below.

Figure 3:
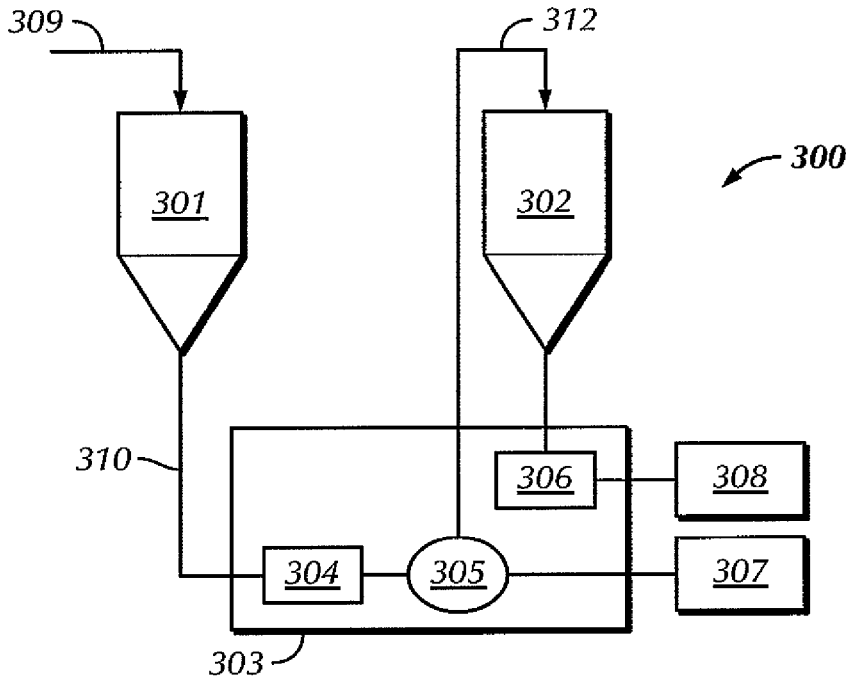
FIGS. 3-6 show systems for recycling drilling fluid according to embodiments of the present disclosure.

Referring to FIG. 3, a system 300 for recycling drilling fluid according to one embodiment of the present disclosure is shown. In this embodiment, system 300 includes a first cuttings storage vessel 301, a second cuttings storage vessel 302, and a module 303. Module 303 includes a pump 304, a valve 305, and a filter system 306. Valve 305 provides fluid communication between first cuttings storage vessel 301 and second cuttings storage vessel 302 and/or a drilling waste reservoir 307. Drilling waste reservoir 307 may be an existing structural element of a drilling rig, such as a mud pit or collection tank, or in alternate embodiments, may be a component of module 303. Drilling waste reservoir 307 may further include a recyclable mud reservoir (not illustrated), which is often referred to as a slop tank on a rig. Second cuttings storage vessel 302 is fluidly connected to filter system 306, and filter system 306 is fluidly connected to a cleaned fluids reservoir 308. Cleaned fluids reservoir 308 may be an existing structural element of a drilling rig, or in alternate embodiments, may be a component of module 303. In certain embodiments, those of ordinary skill in the art will appreciate that either drilling waste reservoir 307 or cleaned fluids reservoir 308 may also include cuttings storage vessels 302.

During operation, used or contaminated drilling fluid, including drill cuttings, particulate matter, suspended materials, chemicals used during the drilling operation, and other materials commonly associated with used drilling fluid is pumped into first cuttings storage vessel 301 via supply line 309. Other types of fluids that may be treated include fluids from various cleaning operations, such as deck and pit cleaning, fluids stored in a slop tank, and fluids from tank cleaning systems used in the separation and cleaning of reusable drilling fluids. The used drilling fluid may be mixed with water in first cuttings storage vessel 301, or pumped into first cuttings vessel 301 without the addition of water and/or other additives. The mixture in first storage vessel 301 may be agitated by mechanical means (e.g., an agitator) or otherwise agitated via the addition of liquids (e.g., additional water) to the mixture. After solid particles have settled to the bottom of first cuttings storage vessel 301, the solid particles of the mixture are pumped out of first cuttings storage vessel 301 by pump 304 through outlet line 310. The extracted mixture may contain both a liquid component and a solid component. Those of ordinary skill in the art will appreciate that due to the separation of solid particles from the used drilling fluid in first cuttings storage vessel 301, the mixture may initially include a higher concentration of solids component than liquid component. The mixture is pumped through valve 305, which, as illustrated, allows for the direction of the pumped mixture to be selected between second cuttings storage vessel 302 and drilling waste reservoir 307.

Initially, the pumped mixture may contain a greater percentage of solids content due to the separation, as describe above. A desirable percentage of solid to liquid content may vary according to specific drilling operation requirements; however, those of ordinary skill the art will appreciate that in at least one embodiment, a desirable initial solid content of the pumped mixture may be greater than 50% by volume. As such, the pumped mixture including a desirable solid to liquid ratio for transfer to drilling waste reservoir 307 will be hereinafter referred to as a positive mixture. In contrast, a pumped mixture including an undesirable solid to liquid ratio for transfer to drilling waste reservoir 307 will be referred to as a negative mixture. Those of ordinary skill in the art will appreciate that in certain embodiments, to recycle drilling fluids efficiently, an acceptable positive condition may be 30% by volume solids, 50% by volume solids, 75% by volume solids, or any volume of solids as determined by a drilling operator. Likewise, acceptable negative conditions, wherein the mixture is pumped to second cuttings storage vessel 302, may be appropriate when the mixture is 70% by volume liquid, 50% by volume liquid, 30% by volume liquid, or any volume as determined by a drilling operator to achieve a desired level of recycling efficiency.

As the pumped mixture is transferred through outlet line 310, valve 305 is actuated to provide fluid communication between first cuttings storage vessel 301 and drilling waste reservoir 307. The positive mixture may continue to be pumped to drilling waste reservoir 307 until a negative mixture condition exists. Such a condition may occur when substantially all of the separated solids content from the mixture in first cuttings storage vessel 301 is extracted.

To determine when such a condition exists, in one embodiment of the present disclosure, outlet line 310 may be sufficiently translucent to allow a drilling operator to visually inspect and thereby determine an approximate solid to liquid ratio of the pumped mixture. Such visual inspection may rely on properties of the mixture such as color, viscosity, and flow rate. Upon determination of a negative condition, the drilling operator may either manually, or using automated assist means, actuate valve 305 to change the direction of flow of the pumped mixture between first cuttings storage vessel 301 and drilling waste reservoir 307 to second cuttings storage vessel 302.

Valve 305 may be fluidly connected to second cuttings storage vessel 302 via any of the connection means discussed above, including, for example, flexible hoses and/or existing piping. As valve 305 is actuated to allow mixture from first cutting storage vessel 301 to transfer to second cuttings storage vessel 302, additional fluids, including water and/or chemical may be added to the mixture. Addition of such fluids may occur either during transfer of the mixture through line 312 (i.e., inline), or after the mixture reaches second cuttings storage vessel 302. In another embodiment, additional fluids may already exist in second cuttings storage vessel 302 when the mixture is pumped thereto.

The mixture in second cuttings storage vessel 302 may be allowed to settle and/or separate further, or otherwise may be agitated using mechanical agitators (i.e., stirrers) or an inflow of fluids, as described above. Those of ordinary skill in the art will appreciate that the level of agitation, if agitation is used, will vary based on the specific properties of the mixture at the time such mixture is transferred to second storage vessel 302. In at least one embodiment, such as in an embodiment using existing ISO-pumps, those of ordinary skill in the art will appreciate that no mechanical agitation means is used.

After sufficient separation of the mixture in second cuttings storage vessel 302, the solution is transferred to filter system 306. Filter system 306 may include a number of different filters including, for example, hydrocarbon filters and filter presses, depending on the specific properties of the drilling fluid being processed. Those of ordinary skill in the art will appreciate that fluids containing substantially low levels of hydrocarbon content may merely be filtered through a hydrocarbon filter, while dense fluids including large amounts of solid matter may be filtered through a filter press, centrifuge, or other filter means. Upon completion of filtration, the cleaned fluid is transferred to cleaned fluid reservoir 308. In certain embodiments, uncleaned fluid, including solids particulate matter or fluid containing high hydrocarbon levels may either be trapped in filter system 306, transferred to drilling waste reservoir (not shown), or recycled to either first cuttings storage vessel 301 or second cuttings storage vessel 302 for further processing. Thus, in at least one embodiment, a cleaning loop may exist allowing for the substantially continuous processing of drilling fluids. In such a loop, cleaned fluids may be collected in a cleaned fluids reservoir 308 for reuse in the drilling operation, while waste products may be separated and collected in the drilling waste reservoir 307 for disposal or further remediation.

Figure 4:
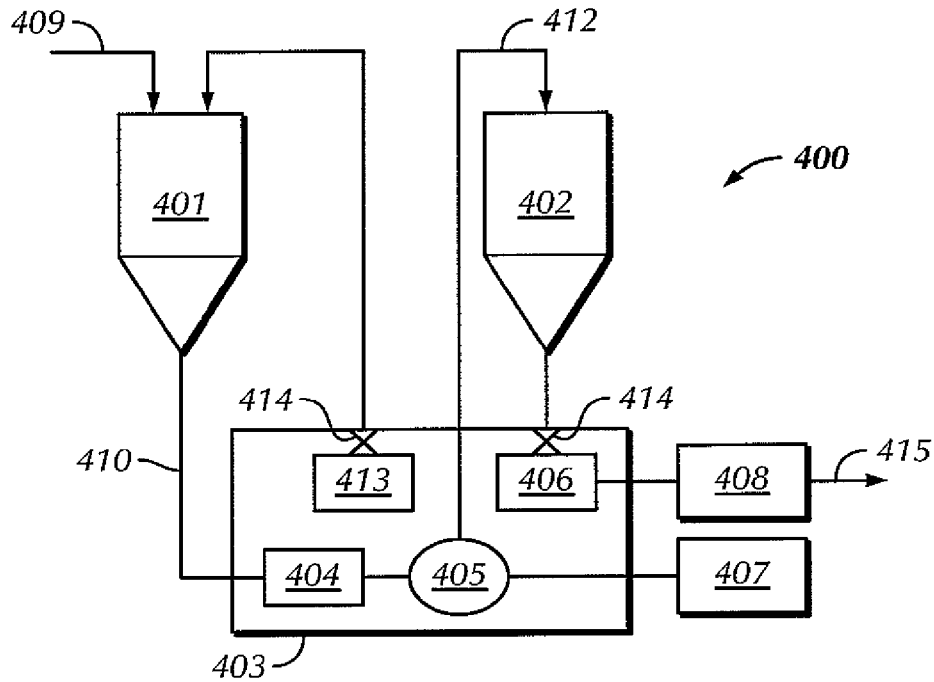

Referring to FIG. 4, a system 400 for recycling drilling fluid in accord with one embodiment of the present disclosure is shown. In this embodiment, system 400 includes a first cuttings storage vessel 401, a second cuttings storage vessel 402, and a module 403. Module 403 includes a pump 404, a valve 405, a dosing tank 413, a filter system 406, and a plurality of control valves 414. Valve 405 provides for the control of fluid communication between first cuttings storage vessel 401 and second cuttings vessel 402 and/or drilling waste reservoir 407. As described above, all structural elements including drilling waste reservoir 407 and supply lines may be existing structures at a drilling location.

In this embodiment, drilling fluid is pumped or otherwise communicated from an upstream cleaning process into first cuttings storage vessel 401 via a supply line 409. In first cuttings storage vessel 401, drilling fluid is mixed with additional water, as described above, or chemical additives to facilitate the precipitation and/or settling of solids particulates and material suspended within the drilling fluid. The additives and/or water may be added from dosing tank 413, wherein such additives are mixed, stored, and/or added to first cuttings storage tank 401 via, for example, an inline pump (not shown). As illustrated, the communication of additives from dosing tank 413 to first cuttings storage tank 401 is controlled by a control valve 414, which may be, for example, a manual valve or an automated valve, and may be controlled through manual actuation or according to batch sequencing, as will be discussed in detail below.

The water and/or chemical additives added to the drilling fluid in first cuttings storage vessel 401 may thereby promote the settling of solid material from the drilling fluid. When a desirable quantity of solid matter has separated to require a recycling operation, the settled positive mixture is pumped via pump 404 through outlet line 410 to primary valve 405. As described above, primary valve 405 controls the flow of the mixture between second cuttings storage vessel 402 and drilling waste reservoir 407. In certain embodiments, drilling waste reservoir 407 may be substituted with a direct feed back to an upstream cleaning operation (e.g., to vibratory shakers) for additional cleaning.

When the mixture reaches a negative condition, primary valve 405 directs the flow of the mixture to second cuttings storage vessel 402 via line 412. The mixture inside second cuttings storage vessel 402 may be allowed to settle and/or separate further. Such separation may be facilitated by addition of chemicals, water, or agitation, as described above. After such separation occurs, the mixture is pumped and/or allowed to drain into filter system 406. Filter system 406 may include any of the types of filters described above, such as hydrocarbon filters and filter presses, for further removing hydrocarbons and/or solid particulate matter from the mixture. Upon completion of the filtration process, the cleaned fluid is directed to cleaned fluid reservoir 408, and the remaining impurities (e.g., hydrocarbons and solid matter) may be trapped in filter system 406, directed to drilling waste reservoir 407, or otherwise collected for eventual disposal and/or further remediation. In this embodiment, cleaned fluid reservoir 408 includes an outlet line 415, which may be used to transfer the cleaned fluids to other operations on the rig. Such operations may include directing the cleaned fluids for use in drilling fluid mixing vessels, fluids used in the slurrification of cuttings for reinjection, fluids used for cleaning operations, or for other operations which require cleaned fluids at a drilling location.

Figure 5:
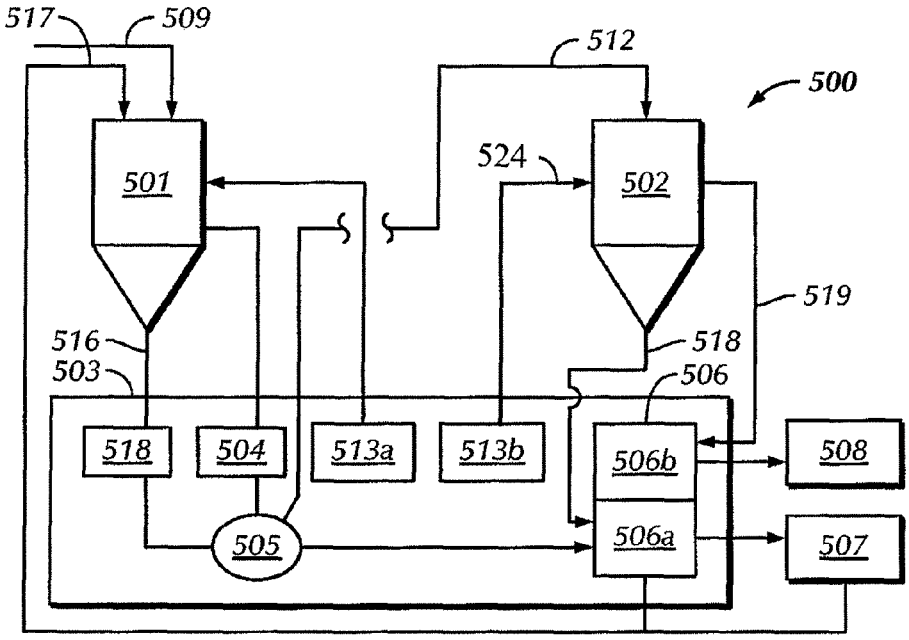

Referring now to FIG. 5, a system 500 for recycling drilling fluid in accord with one embodiment of the present disclosure is shown. In this embodiment, system 500 includes a first cuttings storage vessel 501, a second cuttings storage vessel 502, and a module 503. Module 503 includes a pump 504, a valve 505, dosing tanks 513*a* and 513*b*, and a filter system 506. Valve 505 provides for the control of fluid communication between first cuttings storage vessel 501 and second cuttings vessel 502 and/or drilling waste reservoir 507. As described above, all structural elements including drilling waste reservoir 507 and supply lines may be existing structures at a drilling location.

In this embodiment, a drilling fluid enters first cuttings storage vessel 501 through a supply line 509. The drilling fluid is allowed to separate in first cuttings storage vessel 501 such that solid particles tend to settle toward the bottom of the vessel, while the less dense liquid phase of the drilling fluid separates toward the top of the vessel. This process may be facilitated by injecting chemical additives such as, for example, emulsion clearance agents from dosing tank 513*a* into first cuttings storage vessel 501. Examples of emulsion clearance agents that may be used in embodiments disclosed herein include, for example, anionic surfactants, nonionic surfactants, alkyl polyglycosides, and combinations thereof. Other chemical additives may be injected into first cuttings storage vessel 501 including, for example, various surfactants and wettings agents, such as, fatty acids, soaps of fatty acids, amido amines, polyamides, polyamines, oleate esters, imidazoline derivatives, oxidized crude tall oil, organic phosphate esters, alkyl aromatic sulfates, sulfonates, and combinations thereof. Dosing of such chemical additives may vary according to the requirements of a given fluid recycling operation; however, those of ordinary skill in the art will appreciate that in certain embodiments, minimal amounts of such additives may be used to achieve the desired result.

While drilling fluid separates in cuttings storage vessel 501, the mixture may be agitated, as described above, or in certain embodiments using pressurized cuttings storage vessels, air may be injected into the mixture. The injected air may be controlled by a pneumatic control device (not shown) disposed on module 503. In such an embodiment, an air line (not shown) from an air compressor (not shown) may be coupled to the pneumatic control device (not shown) on module 503 to control a flow of air into first cuttings storage vessel 501. Those of ordinary skill in the art will appreciate that air is only one additional example of a method to agitate the mixture in cuttings storage vessel 501. Other methods may include stirring devices, water injection, chemical injection, heat, steam injection, or any other method of agitating a solution known in the art.

Still referring to FIG. 5, in this embodiment, when the mixture in cuttings storage vessel 501 is separated to a desirable level, the solid cuttings waste that has collected toward the bottom of cuttings storage vessel 501 is pumped out of the vessel via pump 518 through line 516. The mixture is then pumped through valve 505, and if the mixture is in a positive condition, pumped directly to filter system 506. In this embodiment, filter system 506 is a compound filter module including a filter press 506*a* and a hydrocarbon filter 506*b*. The dense, generally solids component, may be further separated from any residual liquid phase, such that filter press 506*a* directs the solids to drilling waste reservoir 507, while directing any liquid phase back to cuttings storage vessel 501 via a return line 517. In certain embodiments, return line 517 may be incorporated into module 503, and the return of any such liquid phase from filter press 506*a* to cuttings storage vessel 501 may be facilitated with a pump (not shown).

When the mixture in first cuttings storage vessel 501 reaches a negative condition, valve 505 may be used to direct the mixture to cuttings storage vessel 502 via line 512. In this embodiment, a substantially liquid portion of the mixture in first cuttings storage vessel 501, in a negative condition, may be pumped to second cuttings storage vessel 502 for further processing by actuation of pump 504, while valve 505 directs the mixture through line 512. As described above, should the condition of the mixture change (i.e., become positive), the mixture may be directed to filter press 506*a*. In still other embodiments, those of ordinary skill in the art will appreciate that multiple valves similar to valve 505 (e.g., R-valves), may be used to direct simultaneous flows of the mixture in first cuttings storage vessel 501 to different components of system 500, such as, for example, filter press 506*a*, drilling waste reservoir 507, or cuttings storage vessel 502, at substantially the same time. Thus, in at least one embodiment, a valve system (not independently illustrated) may be foreseen that promotes the simultaneous processing of both positive and negative mixtures in first cuttings storage vessel 501.

As the mixture is pumped via line 524 into second cuttings storage vessel 502, additional chemicals may be added to the mixture via a dosing tank 513*b*. Examples of chemicals that may be added include anionic surfactants, nonionic surfactant, alkyl polyglycosides, wetting agents, surfactants, flocculants, and other chemicals that are known to those of skill in the art. Examples of the use of such chemical additives in a drilling fluid recycling system are described in U.S. Pat. Nos. 6,977,048 and 6,881,349, previously incorporated by reference in their entirety.

In system 500, the mixture in second cuttings storage vessel 502 may be further separated via chemical injection, as described above, through agitation, or through time-based separation. However, when separation occurs to a desirable level, the mixture may be removed from second cuttings storage vessel 502 via line 518. In this embodiment, the mixture in line 518 may include a substantially solids mixture that may be in a positive condition, as described above, and as such, may be pumped into a filter press 506*a*. Such a condition may exist in a system wherein chemical flocculant is injected into second cuttings storage vessel 502, thereby creating flocs with a density greater than the mixture. However, in other embodiments, the solution in cuttings storage vessel 502 is in a substantially positive condition, and solid sediment does not form. In such a system the mixture may be pumped from cuttings storage vessel 502 into hydrocarbon filter 506*b*, or may be pumped via an outlet in the side of second cuttings storage vessel 502 through a secondary line 519 to hydrocarbon filter 506*b*. As described above, by providing a plurality of lines from second cuttings storage vessel 502, the rate of drilling fluid processing may be increased.

Additional components for facilitating the removal of solid and oil components of the mixture may be added to system 500 without departing from the scope of the present disclosure. Examples of such components may include hydrocyclones, centrifuges, and skimmers, which may be added as additional inline components during the direction of the mixture between first cuttings storage vessel 501 and second cuttings storage vessel 502 and components of module 503. As such, those of ordinary skill in the art will appreciate that additional separation components may be added to module 503, or may operate independent of module 503, and still be considered a component of system 500.

In certain embodiments, a multiple step chemical additive system including first dosing tank 513*a* and second dosing tanks 513*b* may be configured to provide for multiple step chemical injection. For example, first dosing tank 513*a* may include separation chemicals, while second dosing tank 513*b* may include flocculation chemicals. As such, dosing of a chemical to promote separation of solids and other particulate matter from the liquid phase may occur in first cuttings storage vessel 501, while a flocculant is added from second dosing tanks 513*b* to second cuttings storage vessel 502. Those of ordinary skill in the art will appreciate that the addition of the chemical additives, including both separation and flocculation chemicals, may be controlled according to system parameters. Exemplary system parameters include a rate of separation and flocculation within the cuttings storage vessels, a rate of flow through the system, a volume of fluid within the system, and a weight of fluid within the system. Additionally, the chemical additives may be dosed according to such flow rates and/or according to volumes and weights of either the chemical additives or the fluids within the system. Furthermore, in certain embodiments, more than one separation and/or flocculation chemical may be added to either first or second cuttings storage vessel 501 and 502.

After the mixture is processed by filter system 506, the cleaned drilling fluid is directed to cleaned fluid reservoir 508. The fluids may then be collected and/or used in other portions of the drilling operation, as described above.

Figure 6:
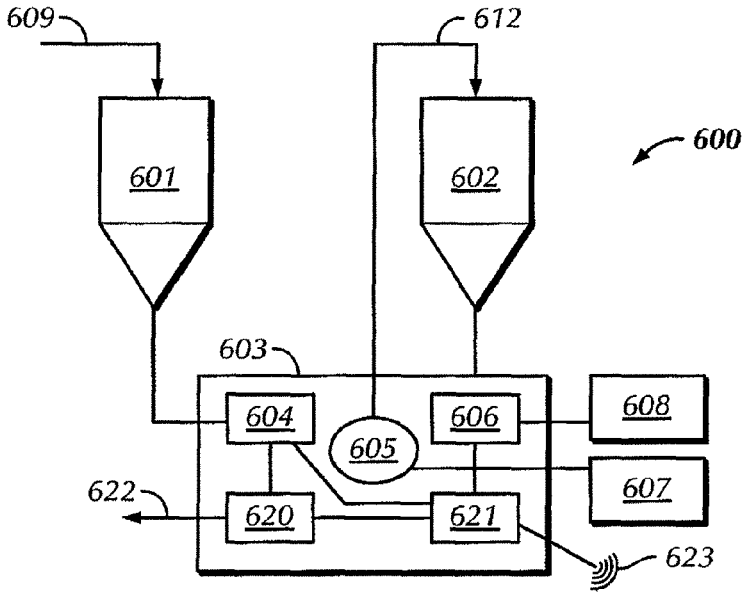

Referring to FIG. 6, a system 600 for recycling drilling fluid according to one embodiment of the present disclosure is shown. In this embodiment, system 600 includes a first cuttings storage vessel 601, a second cuttings storage vessel 602, and a module 603. Module 603 includes a pump 604, a valve 605, a filter system 606, a power supply 620, and a programmable logic controller ("PLC") (621). Valve 605 provides for the control of fluid communication between first cuttings storage vessel 601 and second cuttings vessel 602 and/or drilling waste reservoir 607. As described above, all structural elements including drilling waste reservoir 607 and supply lines may be existing structures at a drilling location.

System 600 works similarly to systems 300, 400, and 500, described above. Briefly, a drilling fluid enters first cuttings storage vessel 601 through supply line 609. The fluid is allowed to separate, and is pumped via inline pump 604 to valve 605. If the mixture from first cuttings storage vessel 601 is in a positive condition, the mixture is sent to drilling waste reservoir 607, or otherwise directed to a press filter (not independently illustrated) of filter system 606. If the mixture is in a negative condition, the mixture is directed to second cuttings storage vessel 602 via line 612. After further separation in second cuttings storage vessel 602, the fluid is transferred to filter system 606 for the additional removal of residual solids and/or hydrocarbons. The cleaned fluid is then directed to a cleaned fluids reservoir 608 for use in other drilling operations.

In this embodiment, system 600 includes an independent power source 620 for providing power to components of module 603. Power source 620 is electrically connected to, for example, pump 604, valve 605, filter system 606, and/or PLC 621. Those of ordinary skill in the art will appreciate that such a power source may provide primary or auxiliary power for powering components of module 603. In other embodiments, power source 620 may be merely an electrical conduit for connecting a power source on a rig (not shown) via an electrical cable 622, to module 603.

System 600 also includes PLC 621, operatively connected to, for example, pump 604, valve 605, and/or filter system 606. In this embodiment, PLC 621 provides instructions for controlling the rate of flow of the mixture of first cuttings storage vessel 601 through valve 605 to, for example, second cuttings storage vessel 602. Controlling the rate of flow may include controlling the operation of pump 604 or valve 605. In one embodiment, PLC 621 may provide for the automated control of valve 605, directing the flow of the mixture from first cuttings storage vessel 601 to second cuttings storage vessel 602. Such control may occur as a result of valve 605 including a sensor. Examples of such sensors may include density sensors, conductivity sensors, or other sensors known to those in the art for determining a condition of a drilling fluid, such as, a density. Such an embodiment may allow module 603 to automatically control the speed of the recycling of the drilling fluid to obtain an optimal condition for a drilling operation. An optimal condition may include cleaning a drilling fluid to a determined level for use in the drilling operation. Those of ordinary skill in the art will appreciate that such a system may be used to reduce the hydrocarbon content of a fluid to less than, for example, 20 ppm, to meet environmental regulations defining the condition for disposable fluids. In other operations, the hydrocarbon content may be reduced to substantially 35 ppm, and the fluid may be used in other components of the drilling operation. Those of ordinary skill in the art will appreciate that such hydrocarbon levels are merely examples of how such a system 600 may be used to clean and recycle drilling fluids.

Still referring to FIG. 6, PLC 621 may provide for external communication of module 603 with a rig management system. Rig management systems may include, on-rig systems used to control drilling operations, drill cuttings cleaning operations, environmental systems, and data collection systems. As such, PLC 621 may record and/or analyze data such as time of drilling fluid recycling, the amount of drilling fluid recycled, the amounts of chemicals used in the operation of system 600, power usage, and other data that may be used by a drilling operator to further increase the efficiency of the drilling operation. In still other embodiments, PLC 621 may allow module 603 to be operatively coupled with other modules to use the cleaned fluids of system 600 to, for example, clean tanks, reinject cuttings into a wellbore, create slurry, or further remediate drill cuttings and/or fluids.

To promote such interconnectivity, module 603 may include a data communication device, such as, for example, a wireless access point 623, thereby allowing module 603 and/or system 600 to communicate remotely with other systems, modules, rig management systems, or other remote communication devices known to those of skill in the art. Such an access point 623 may further allow module 603 to be controlled, or data acquired therefrom remotely.

Those of ordinary skill in the art will appreciate that components of systems 300, 400, 500, and 600 may be interchanged, interconnected, and otherwise assembled in a drilling fluid recovery system. As such, to address the specific requirements of a drilling operation, the components of the systems and modules disclosed herein may provide for an interchangeable and adaptable system for the cleaning and/or recycling of drilling fluids at a drilling location.

Advantageously, embodiments disclosed herein may provide for systems and methods that more efficiently clean and recycle drilling fluids on a drilling rig. Because offshore platform space is often limited, and crane operations to transfer drilling fluid cleaning systems are often expensive and dangerous, embodiments of the present disclosure may decrease the cost of drilling operations by decreasing the number of crane lifts. Additionally, modules of the present disclosure may allow for existing infrastructure of an offshore platform to perform multiple functions, such as, allowing cuttings storage vessels to be used in both the storage and transfer of cuttings, as well as, being used in a drilling fluid recycling operation. Furthermore, the system may promote the use of environmentally safe cleaning operations (i.e., recycling drilling fluid), thereby enhancing the environmental condition of the drilling operation. Finally, by decreasing time associated with changing drilling equipment for cleaning operations, the present disclosure may decrease downtime of a drilling operation, thereby increasing drilling efficiency, while decreasing cost.

While the disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system for recycling a drilling fluid comprising:
- a first cuttings storage vessel, wherein the first cuttings storage vessel comprises a pneumatic transfer device;
- a second cuttings storage vessel; and
- a module fluidly connected to the first and second cuttings storage vessels, the module comprising:
  - a valve configured to fluidly connect the first and second cuttings storage vessels, wherein the valve comprises a sensor for determining a condition of the drilling fluid;
- a filter system configured to fluidly connect to at least the second cuttings storage vessel;
- at least one pump to facilitate the flow of a fluid between the first and second cuttings storage vessels; and a programmable logic controller operatively coupled to the module, wherein the programmable logic controller provides instructions to the valve for controlling the flow of fluid between the first and second cuttings storage vessels resulting from said condition determined by said sensor.

2. The system of claim 1, wherein the valve is configured to automatically adjust the flow of the fluid between the first and second cuttings storage vessels.

3. The system of claim 1, wherein the sensor is one selected from a group consisting of a density sensor and a conductivity sensor.

4. The system of claim 1, wherein the filter system comprises a hydrocarbon filter.

5. The system of claim 1, wherein the filter system comprises a filter press.

6. The system of claim 1, further comprising a second pump to facilitate the flow of the fluid between the second cuttings storage vessel and a third storage vessel.

7. The system of claim 6, wherein the second pump is configured to facilitate the flow of the fluid through the filter system.

8. The system of claim 1, further comprising a chemical additive system comprising at least one chemical dosing tank.

9. The system of claim 8, wherein the chemical dosing tank is configured to supply at least one of a separation chemical and a flocculant to one or more of the cuttings storage vessels.

10. The system of claim 8, wherein the chemical additive system comprises:
- a first chemical dosing tank configured to provide a separation chemical to the first cuttings storage vessel; and
- a second chemical dosing tank configured to provide a flocculant to the second cuttings storage vessel.

11. The system of claim 1, wherein at least one of the first and second cuttings storage vessels is disposed outside the module.

12. A module for use at a drilling location comprising:
- a valve for directing drilling fluid between at least a first cuttings storage vessel disposed outside the module and a second cuttings storage vessel disposed outside the module, wherein at least the first cuttings storage vessel comprises a pneumatic transfer device, and wherein the valve comprises a sensor for determining a condition of the drilling fluid;
- a filter system for filtering the drilling fluid;
- at least one pump for facilitating the flow of the fluid between at least the first and second cuttings storage vessels; and a programmable logic controller operatively coupled to the module, wherein the programmable logic controller provides instructions to the valve for controlling the flow of fluid between the first and second cuttings storage vessels resulting from said condition determined by said sensor.

13. The module of claim 12, wherein the valve is configured to automatically adjust the flow of the fluid between the first and second cuttings storage vessels.

14. The module of claim 12, wherein the sensor is one selected from a group consisting of a density sensor and a conductivity sensor.

15. The module of claim 12, wherein the filter system comprises at least a filter selected from a group consisting of hydrocarbon filters and press filters.

16. The module of claim 12, further comprising:
- an emulsion clearance agent addition device; and
- a flocculant addition device.

* * * * *